United States Patent [19]

Bell et al.

[11] Patent Number: 4,467,322

[45] Date of Patent: Aug. 21, 1984

[54] DIGITAL SHADE CONTROL FOR COLOR CRT BACKGROUND AND CURSORS

[75] Inventors: Wayne D. Bell, Bountiful; Thomas K. McFarland, Salt Lake City, both of Utah

[73] Assignee: Sperry Corporation, New York, N.Y.

[21] Appl. No.: 412,688

[22] Filed: Aug. 30, 1982

[51] Int. Cl.[3] ..... G09G 1/28

[52] U.S. Cl. ..... 340/701; 340/703; 340/704; 340/709; 358/27

[58] Field of Search ..... 340/701, 703, 704, 711, 340/709, 793; 358/27, 29, 81

[56] References Cited

U.S. PATENT DOCUMENTS

| | | | |
|---|---|---|---|
| 3,668,686 | 6/1972 | Strohmeyer | 340/704 |
| 3,911,418 | 10/1975 | Takeda | 340/703 |
| 4,310,838 | 1/1982 | Suso et al. | 340/701 |
| 4,388,639 | 6/1983 | Cox et al. | 358/27 |

FOREIGN PATENT DOCUMENTS

| | | | |
|---|---|---|---|
| 2124 | 1/1977 | Japan | 340/701 |
| 66127 | 6/1978 | Japan | 340/701 |
| 90728 | 8/1978 | Japan | 340/709 |

*Primary Examiner*—Gerald L. Brigance

*Attorney, Agent, or Firm*—John B. Sowell; Kenneth T. Grace; Marshall M. Truex

[57] ABSTRACT

A color cathode ray tube is provided in a color monitor of a video display terminal. The red, green and blue color video input lines are connected to novel control circuits which permit the selection of several different shades of colors for the background or cursor. The circuits which control the background colors are pulse modulated to provide digital shade control of the background color selected and automatically control the color of the cursor so that a contrasting color is provided.

9 Claims, 1 Drawing Figure

DIGITAL SHADE CONTROL FOR COLOR CRT BACKGROUND AND CURSORS

BACKGROUND OF THE INVENTION

1. Field of the Invention

This invention relates to the control of the color and the shade of the background and cursor in the video display terminal. More particularly, this invention relates to a novel circuit for controlling the shade and the color in commercially available color cathode ray (CRT) monitors.

2. Description of the Prior Art

Prior art color monitors were either provided with manual brightness and contrast controls or no controls at all. Such controls affect the shade and brightness of the background and cursor. The prior art manual brightness and contrast controls are analog devices which control the voltage amplitude at the cathode of the CRT so as to change the intensity of the color being painted on the CRT. Those skilled in the art of color monitor controls are aware that such manual analog brightness and contrast controls of the type presently employed in commercially available television sets do not provide for digital brightness and contrast controls. A digital to analog conversion circuit is required.

It is also known in the color television art that automatic analog controls are employed in some of the more expensive television sets for automatically controlling the foreground contrast, brightness and tint. These analog devices are extensions of the aforementioned prior art manual controls.

One of the problems which arise in providing a cursor on a color monitor is that it is difficult to detect the cursor. Heretofore, the color of the cursor was made the color of the foreground characters or the color of the background. In some of the latest improved color monitors, the color of the cursor has been alternated between the color of the foreground character and the background color. When the foreground characters are displayed with a cursor where the characters and the cursor have the same color and same intensity, it is very difficult to detect the cursor. To overcome this difficulty, it has been a common practice to provide a cursor with a circuit which causes it to blink. When the cursor is the same color and intensity as the background color, it is very difficult to detect the cursor even when the cursor is provided with a blinking circuit.

It would be desirable to provide in a color video display terminal automatic color and background shade control circuits which have the capability to enhance the contrast of the alpha/numeric data on the screen without obscuring the characters with a full intensity background.

SUMMARY OF THE INVENTION

It is a principal object of the present invention to provide novel background and cursor color and shade control circuits.

It is another principal object of the present invention to provide a circuit which changes the color of the cursor so that it remains highly visible relative to the foreground and background colors.

It is a general object of the present invention to provide automatic color and shade control circuits which are adaptable to existing color video display terminals.

It is another object of the present invention to provide a novel shade and color control circuit which is cheaper and simpler than manual control circuits of the prior art.

It is another object of the present invention to provide a digital circuit for the automatic control of the color and shade of the background employing pulse width modulation.

According to these and other objects of the present invention, there is provided a color video display terminal which comprises function keys for the selection of background and foreground colors. The function keys cause the generation of color selection signals which are processed by the novel color and shade control circuits so as to attenuate the original color control signals. When the attenuated color control signals are applied to the cathode ray tube, the shade of the selected color is darkened. Further, the color selection signals are gated through novel gating circuits which change the color of the cursor so that it is never the same color and shade of the background color.

DESCRIPTION OF THE PREFERRED EMBODIMENT

Figure 1:
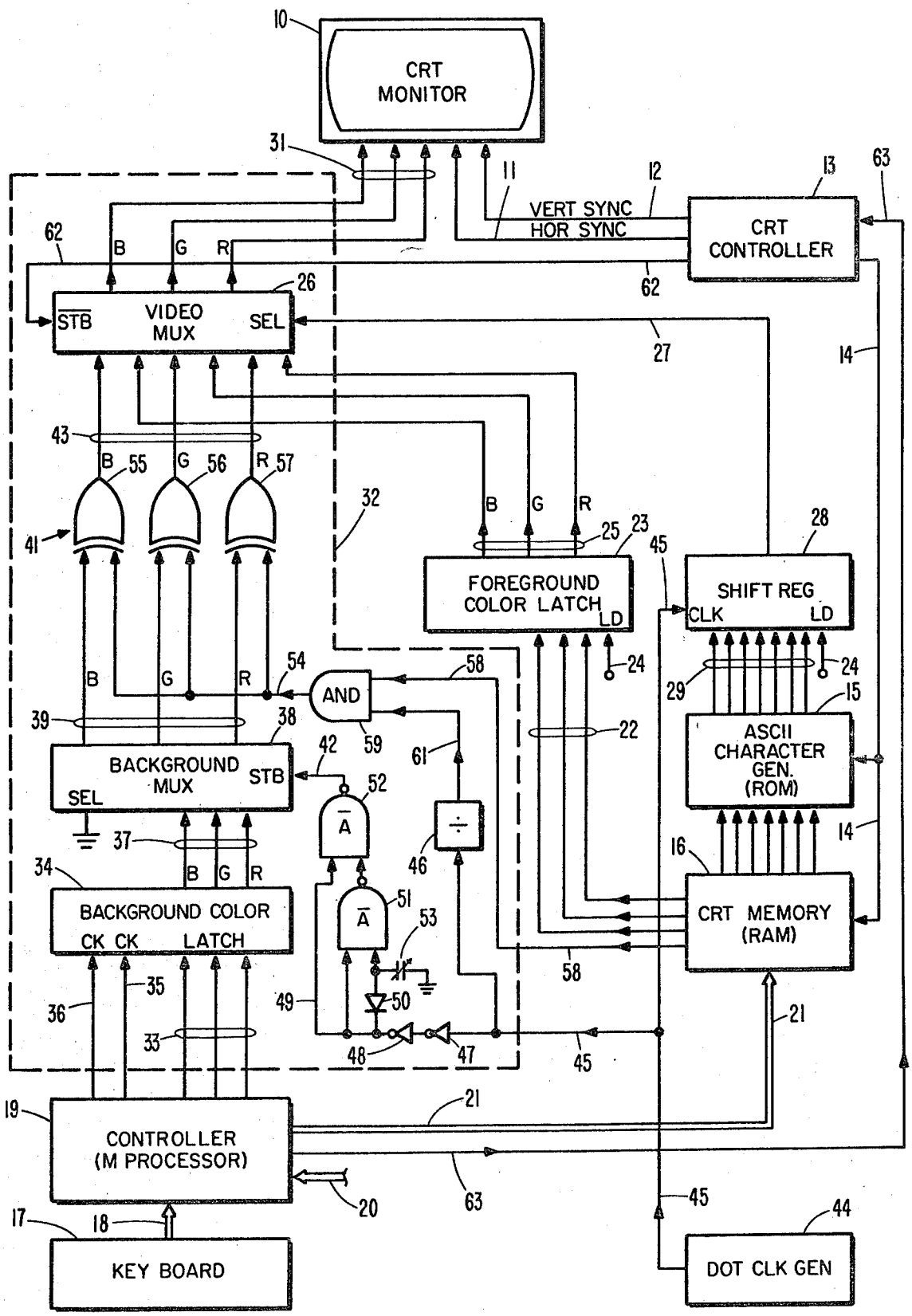
FIG. 1 is a block diagram showing the novel background color and shade control circuit which is connected to conventional CRT character control and sync control circuits.

Refer now to FIG. 1 showing a CRT color monitor 10 which comprises a color tube and the known electronics for supplying a raster scan (not shown). The horizontal and vertical sync signals to the monitor 10 are shown being supplied via lines 11 and 12 from the CRT controller 13. The CRT controller 13 also supplies timing signal via line 14 to a character generator 15 and a CRT memory 16.

Keyboard 17 is connected via bus 18 to a controller 19 and provides means for loading data and character information into memory 16 via bus 21. The alpha/numeric character information which is stored in CRT memory 16 is displayed on monitor 10 as foreground information in the foreground color. The function keys (not shown) of keyboard 17 permit the selection of one primary foreground color. The foreground color is stored in memory 16 and provides foreground color selection signals via lines 22 to latch 23. The color selection signals on lines 22 are strobed by strobe line 24 into latch 23. The color selection signals on lines 22 are held in the latch 23 for one full character time and displayed on lines 25 as an output to the video selection means 26 which in the preferred embodiment is a simple multiplexor. Bus 20 from an electronic processor (not shown) is capable of supplying the same data to controller 19 as keyboard 17.

The lines 25, which contain the foreground color selection signal information, define the color of the alpha/numeric character being displayed on CRT monitor 10, however, the character dot information, or timing information, of the electron beam is being supplied via line 27 from shift register 28. Shift register 28 is loaded from the ASCII character generator 15 via lines 29. However, when the aforementioned electron beam is turned off between the character dot information time, the background area between the character dots is black or dark and no signal is being provided on color video lines 31, commonly referred to as the red, green, blue (RGB) lines 31.

In most prior art color monitors, the background was allowed to remain dark. It was heretofore possible to employ color selection signal lines 22 to paint the background information as a reverse character. However, this was found to be an expensive way to supply full intensity background color information for monitors which were not already provided with special circuits in the original equipment. It would be costly to attempt a retrofit of such background color circuits in existing monitors. It will be understood that the circuits described hereinbefore are typical color monitor circuits and that the circuits to be described hereinafter which provide the novel background and color shade control are shown within phantom lines 32. Lines 25 and lines 31 would have been directly connected to monitor 10 in the prior art circuits without the requirement of the multiplexor 26.

The novel color and shade control circuits for the background colors are designed to enhance the color contrast between background and foreground. Further, the novel background color and shade control circuits are designed to change the intensity of the background using digital control circuits so that when both the background and the foreground colors are the same, the alpha/numeric information is clearly visible on the background. Also, the novel background color control circuits are designed to make the cursor more visible by changing the color of the cursor to a color which is different from the background color.

Keyboard 17 is provided with a set of background color function keys (not shown). Controller 19, which is preferably an inexpensive microprocessor, supplies the background color selection signals on lines 33. The color selection signals on line 33 are stored in latch 34 until they are replaced with another set of signals on lines 33. When a new color is selected via controller 19, a signal on load line 35 loads the new color on lines 33 into latch 34. A reset line 36 from controller 19 is also provided to latch 34 to provide means for clearing the color latch 34.

The last selected background color selection signals appear on lines 33 at the latch output lines 37 to the pulse width modulation means 38. In the preferred embodiment circuit shown in FIG. 1, the pulse width modulation means 38 comprise a strobed multiplexor 38. Multiplexor output lines 39 are applied to gating means 41 which are shown as three EXCLUSIVE OR gates. The background color selection signals do not appear on output lines 39 until there is a strobe or enable signal provided on line 42. It will be understood that there is a pulse width modulation strobe signal on line 42 during every dot time and that a signal will be produced on lines 39 during every dot time. The signal on lines 39, indicative of the background color and shade information, initiates signals on output lines 43 from gates 41 which are incapable of passing through the multiplexor 26 during alpha/numeric character generation time because of the alpha/numeric strobe signal on line 27 to multiplexor 26.

When the strobe signal on line 42 is adjusted so that the enable state lasts for the complete dot clock time, the intensity of the color on the background color selection signals lines 43 will be full or bright intensity. However, if the duration of the strobe or enable signal on line 42 is less than the dot clock time, the intensity of the background color will be attenuated and a darker different shade will be presented as the background color on the CRT monitor 10.

Dot clock generator 44 is preferably an oscillator which produces an output signal on line 45 which is representative of the duration of the dot clock time. The dot clock time signal on line 45 is applied to a divider 46 which steps down the dot clock frequency by a predetermined count. The dot clock time is applied to a pair of inverters 47 and 48 which operate as a dot clock buffer. The modified dot clock time signal on line 49 is applied to a one shot multivibrator circuit which comprises diode 5, NAND gates 51 and 52 and an adjustable capacitor 53. In the preferred mode of operation, proper adjustment of the capacitor 53 will result in the reduction of the dot clock time on line 42. When the strobe signal on line 42 is less than the full predetermined dot clock time, the video signals being used for the background color actually cause fewer electrons to hit the phosphorus screen for less linear distance of the raster travel time. The end result of supplying fewer electrons to the phosphor dot area results in a shading toward black or a darker color.

As long as there is no cursor selection signal on line 54 to the EXCLUSIVE OR gates 55, 56 and 57 the same background color selection signals on lines 39 will appear at the output of the gating means 41 on lines 43.

The CRT memory 16 supplies a cursor attribute signal on line 58 which is an indication of cursor time. The cursor time signal on line 58 is applied to AND gate 59. AND gate 59 is enabled and disabled by the signal on line 61 from the divider 46 which provides means for blinking the cursor.

In order to provide a cursor color which differs from the background color, novel gating selection means 41 are provided. As explained hereinbefore, the background color selection signals 39, which may be attenuated, will appear in the form in which they are produced from the pulse width modulation means 38 on the output lines 43. However, when the cursor selection signal is present on line 54 to the EXCLUSIVE OR gates 55, 56 and 57, the output on lines 43 is complemented so that the cursor color will be a complementary color from the background color.

A simple and preferred mode of operation is provided by gating means 41. It will be understood that the EXCLUSIVE OR gates 55, 56 and 57 may be replaced with other gating selection means which will change the color of the cursor relative to the background color.

To prevent the generation of color signals on lines 31 during the time the raster scan is retracing, a blanking signal is provided on line 62, from the CRT controller 13. Coordination between the controller 19 and the controller 13 is provided by a bus 63.

Having explained a preferred embodiment digital background color and shade control circuit, it will be understood that the parts employed are commercially available parts which may be purchased for less than five dollars. When the preferred embodiment circuit is embodied into a new video display terminal, no modification of the existing components of a video display terminal are necessary and no additional space in the CRT memory is used. Those skilled in electronic digital circuit design may now substitute other functional parts and still maintain the novel and preferred mode of operation which provides automatic shade control of the background color and further provides a contrast color for the cursor which is different or stands out from the background color.

We claim:

1. Apparatus for changing the shade of the background color in a cathode ray tube of a video display, comprising:

means for selecting a predetermined background color and for generating background color selection signals, means for storing said background color selection signals coupled to said means for selecting a predetermined background color, pulse width modulation means coupled to said means for storing said background color selection signals and for gating said color selection signals, timing means coupled to said pulse width modulation means for changing the duration of said background color selection signals, cathode ray tube display means, and video signal selection means coupled to said pulse width modulation means and to said cathode ray tube for supplying attenuated background color selection signals to said cathode ray tube and for generating background color shades.

2. Apparatus for changing the shade of the background color as set forth in claim 1 wherein said means for selecting a predetermined background color comprises;

a keyboard having color selection keys, an electronic controller coupled to said keyboard, said electronic controller having means for generating said background color selection signals.

3. Apparatus for changing the shade of the background color as set forth in claim 1 which further includes means for changing the background color selection signals being applied to said video signal selection means.

4. Apparatus for changing the shade of the background color as set forth in claim 3 wherein said means for changing the background color selection signals includes gates for selecting predetermined different color selection signals.

5. Apparatus for changing the shade of the background color as set forth in claim 4 wherein said gates for selecting predetermined different color selection signals comprises EXCLUSIVE OR gates.

6. Apparatus for changing the shade of the background color as set forth in claim 4 which further includes cursor selection means coupled to said gates for selection of predetermined different color selection signals.

7. Apparatus for changing the shade of the background color as set forth in claim 6 wherein said predetermined different color selection signals are adapted to produce a complementary color.

8. Apparatus for changing the color of the cursor with respect to the background color in a cathode ray tube of a video display, comprising;

means for selecting a predetermined background color and for generating background color selection signals, means for storing said background color selection signals coupled to said means for selecting a predetermined background color, pulse width modulation means coupled to said means for storing said background color selection signals and for gating said color selection signals, means for changing the background color selection signals coupled to said pulse width modulation means, cursor selection means coupled to said means for changing the background color selection signals, and cathode ray tube display means coupled to said means for changing said background color selection signals.

9. Apparatus for changing the color of the cursor as set forth in claim 8 which further includes, timing means coupled to said pulse width modulation means for changing the duration of said background color selection signals and generating attenuated colors.

* * * * *